US005755198A

United States Patent [19]

Grob et al.

[11] Patent Number: 5,755,198

[45] Date of Patent: May 26, 1998

[54] CONTROL DEVICE FOR A GASOLINE-POWERED DIRECT INJECTION INTERNAL COMBUSTION ENGINE

[75] Inventors: Ferdinand Grob, Besigheim; Hartmut Bauer, Gerlingen; Uwe Maienberg, Stuttgart; Klaus Scherrbacher, Schwieberdingen, all of Germany

[73] Assignee: Robert Bosch GmbH

[21] Appl. No.: 812,633

[22] Filed: Mar. 7, 1997

[30] Foreign Application Priority Data

Mar. 27, 1996 [DE] Germany ..... 196 12 150.7

[51] Int. Cl.[6] ..... F02B 17/00

[52] U.S. Cl. ..... 123/295

[58] Field of Search ..... 123/295, 305, 123/478, 730, 301, 430, 300, 310; 364/431.05

[56] References Cited

U.S. PATENT DOCUMENTS

| | | | |
|---|---|---|---|
| 5,078,107 | 1/1992 | Morikawa | 123/295 |
| 5,095,874 | 3/1992 | Schnaibel et al. | 123/361 |
| 5,170,760 | 12/1992 | Yamada et al. | 123/295 |
| 5,191,531 | 3/1993 | Kurosu et al. | 364/431.05 |
| 5,333,583 | 8/1994 | Matsura | 123/295 |
| 5,483,934 | 1/1996 | Stutzenberger | 123/305 |
| 5,558,178 | 9/1996 | Hess et al. | 180/197 |
| 5,666,916 | 9/1997 | Fujieda et al. | 123/295 |

FOREIGN PATENT DOCUMENTS

| | | | |
|---|---|---|---|
| 39 30 396 C | 3/1991 | Germany | 123/295 |
| 42 39 711 A1 | 6/1994 | Germany | 123/295 |
| 43 32 171 A1 | 3/1995 | Germany | 123/295 |

*Primary Examiner*—Raymond A. Nelli
*Attorney, Agent, or Firm*—Kenyon & Kenyon

[57] ABSTRACT

A control device for a direct-injection gasoline engine with sensors for operating parameters, a signal processing unit, as well as metering and actuating devices for at least fuel mass, fuel pressure, air mass, and ignition.

4 Claims, 5 Drawing Sheets

CONTROL DEVICE FOR A GASOLINE-POWERED DIRECT INJECTION INTERNAL COMBUSTION ENGINE

FIELD OF THE INVENTION

The present invention relates to a control device for a direct-injection gasoline engine.

BACKGROUND INFORMATION

German Patent No. 43 32 171 A1 discloses processes for operating a four-stroke internal combustion engine with external ignition and direct injection, and a device for carrying out the process. In FIG. 2 of this patent, the entire operating range of the internal combustion engine is divided into several zones according to speed and load and, depending on the operating zone, fuel is injected either during the intake stroke or the compression stroke. When injection takes place during the intake stroke, the most homogeneous fuel distribution is achieved due to the time available prior to ignition and due to the turbulence of the injected fuel caused by the intake air current (homogeneous operation), while in the case of injection during the compression stroke, stratification takes place (stratified operation). In this prior art device, an electronic controller is responsible for switching between homogeneous and stratified operation, on the basis of the parameters and predefined criteria; it also determines the injection values.

German Patent No. 42 39 711 A1 concerns a process and device for controlling a motor vehicle. Interfaces are defined between different subsystems, one of which is an engine control system, through which interfaces torque-based information can be exchanged to control the vehicle.

Finally, German Patent No. 39 30 396 C concerns a process for setting the amounts of air and fuel for a multi-cylinder internal combustion engine, wherein fuel is metered and an air regulating actuator is controlled on the basis of different operational parameters.

SUMMARY OF THE INVENTION

An object of the present invention is to provide a control device for a direct injection gasoline engine that is optimized from the point of view of exhaust characteristics and fuel consumption and that is also easy to modify for different vehicles and models.

The control device for a direct-injection gasoline engine according to the present invention makes it possible to clearly define the individual processing steps in the controller and to ensure optimum exhaust and fuel consumption characteristics during homogeneous and stratified direct-injection operation.

DETAILED DESCRIPTION

Figure 1:
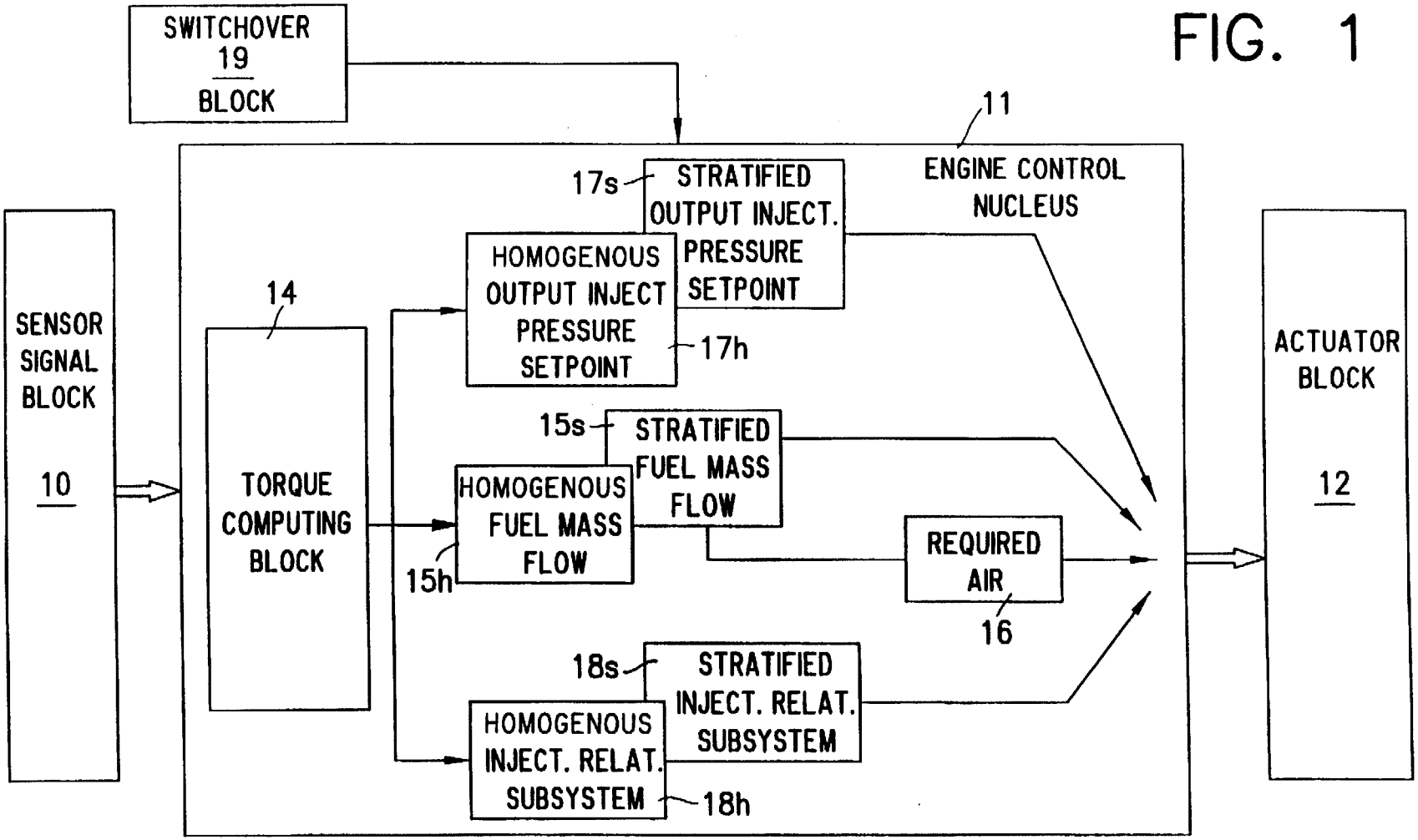
FIG. 1 shows a schematic of the controller architecture with the different blocks for obtaining the operating parameters, signal processing as a function of homogeneous and stratified operation, and finally the output to the individual actuators and servo-mechanisms, such as injection valves, throttle valve actuators, and ignition systems.
Figure 5:
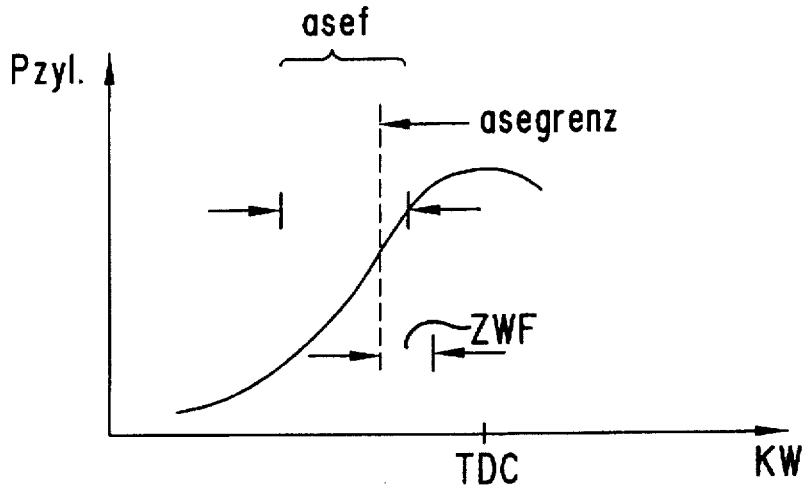
FIG. 5 shows the variation of the cylinder pressure, with an explanatory illustration of the position of the possible ignition angles and injection signal control ends.

FIG. 1 shows a rough schematic of the control device architecture for the direct-injection gasoline engine with switchover option from homogeneous to stratified operation. Operating parameters such as speed, pressures, and temperatures are available at the output of sensor signal block 10. It is followed by the actual engine control nucleus 11, in turn followed on the output side by an actuator block 12. All actuators, such as injection valves, throttle valve actuators, and ignition system, are combined in this actuator block 12. Torque is computed in block 14 within engine control nucleus 11, i.e., depending on the individual operating parameters and the driver's wish, a torque value is generated and made available, which controls the setpoint of the individual manipulated variables of the internal combustion engine such as fuel and air delivery and injection pressure, as well as the ignition system. Block **15*h* computes the fuel mass flow for the injection valve in homogeneous operation. Similarly block 15*s* computes the signals responsible for fuel delivery in stratified operation. Block 16 determines the required amount of air at a given operating point. Signal blocks 17*h* and 17*s* output injection pressure setpoints in homogeneous and stratified operation, respectively. Blocks 18*h* and 18*s* are ignition-related subsystems also separated according to the requirements of homogeneous and stratified operation. Finally, engine control nucleus 11 also has a switchover block 19** for determining the switchover points between homogeneous and stratified operation, mainly as a function of the operating point in the load and speed diagram (FIG. 5). In addition, switchover points can be affected by other functions such as tank venting, exhaust recycling, etc.

The separation between sensor block 10, torque computing block 14, the individual blocks for determining the fuel and air amounts needed, the injection pressure, as well as the ignition power in homogeneous and stratified operation, and finally actuator block 12, where the required fuel mass flow and the corresponding injection time is converted, is essential for the embodiment of FIG. 1. It should also be mentioned that the object of the above-mentioned German Patent No. 42 39 711 A1 can be used as torque computing block 14 in engine control nucleus 11.

Figure 2:
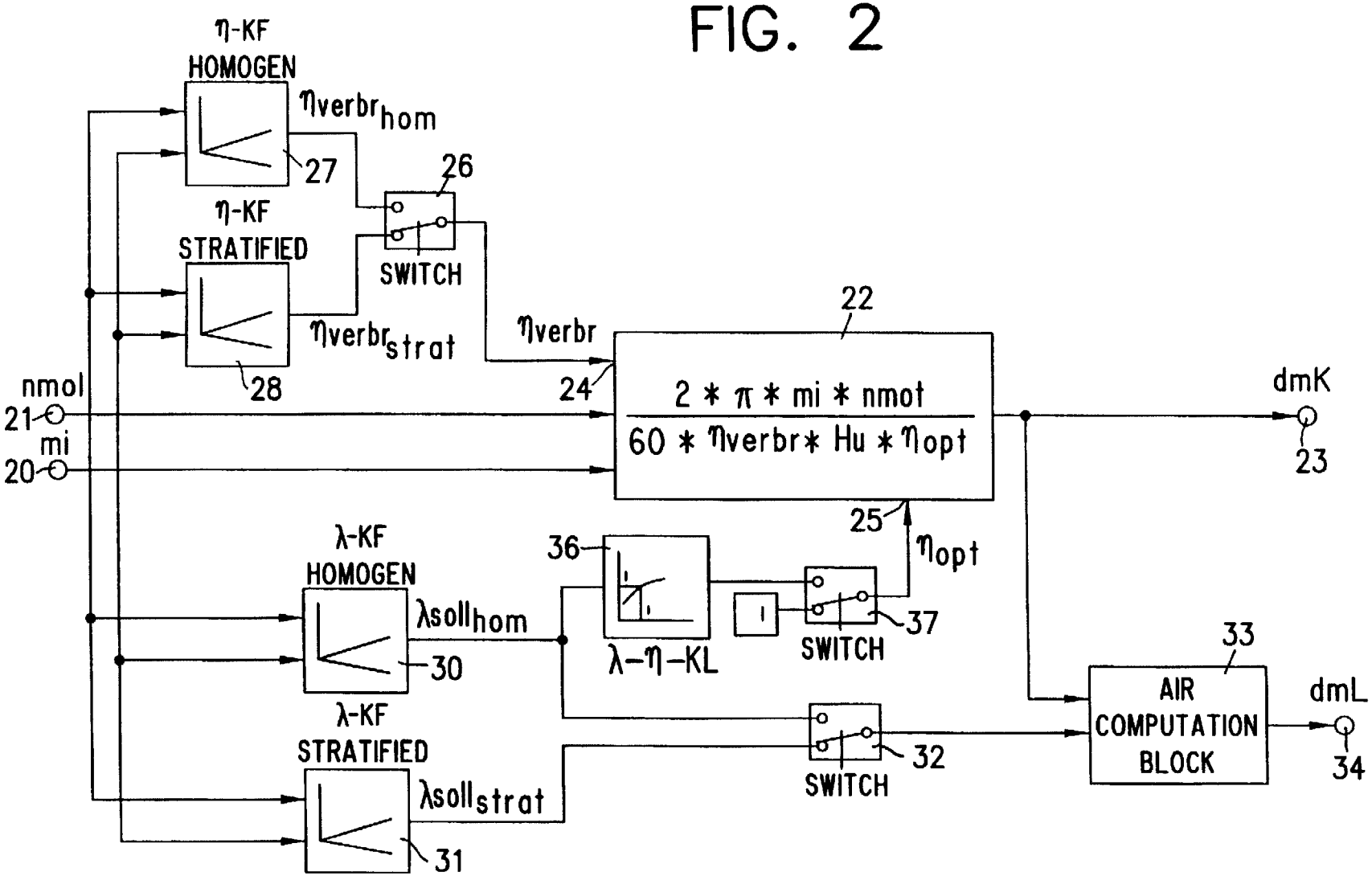
FIG. 2 shows a schematic of the conversion of the indicated motor torque into signals regarding fuel and air mass flow.

FIG. 2 shows, in a block diagram, the conversion of the desired indicated engine torque mi into the required values for fuel mass flow dmK and air mass flow dmL. The indicated engine torque mi is made available at the input on first terminal 20. A signal regarding the engine speed nmot is applied to a second terminal 21. A computing block 22 follows, at whose output the value of the fuel mass flow dmK is made available at output terminal 23 according to the following formula:

$$dmK=(2*\Pi*mi*nmot)/(60*\eta verbr*Hu*\eta opt)$$

In addition to the values mi and nmot, two additional values, related to the degree of combustion ηverbr and the optimum efficiency ηopt are supplied to computing block 22 through two other inputs 24 and 25 respectively. In particular, a map value ηverbr_hom and ηverbr_schicht are supplied from maps 27 and 28 respectively to input 24 of computing block 22 via a switch 26, depending on whether homogeneous or stratified operation is desired. Maps 27 and 28 are connected, on the input side, with inputs 20 and 21, where the signals of the indicated engine torque mi and engine speed nmot are made available.

Parallel to the above-described fuel path with computing block 22, the air path is illustrated at the bottom of FIG. 2, where two λ maps for homogeneous and stratified operations, respectively (30, 31), are provided at input terminals 20 and 21. λ setpoints for homogeneous and stratified operation can be read from said maps. Both λ maps 30 and 31 are followed by a switch 32, which can forward the desired λ setpoints to a subsequent air computing block 33 for homogeneous and stratified operation. This air computing block 33 also contains a value regarding the fuel mass flow dmK and thus is connected to the output of computing block 22. In air computing block 33, an air mass flow value dmL is calculated as a function of the required fuel mass flow dmK and the desired λ setpoint from maps 30 and 31, and is made available at an output 34.

Finally, the output signal of λ map 30 is supplied for homogeneous operation to input 25 for the ηopt value of computing block 22 via a λ-η characteristic curve 36. In the specific embodiment shown, a fixed value is defined for stratified operation at the second input of switch 37.

Thus, FIG. 2 shows a method for making available, through computation, values for fuel mass flow dmK and air mass flow dmL for both homogeneous and stratified operation on the basis of the desired indicated engine torque mi and the current engine speed nmot. Of course, correction options can also be provided within or in the area of computing block 22 in order to account for the effect of exhaust recycling or other factors affecting the physical characteristics of the internal combustion engine regarding the relationship between fuel and air supplied vs. torque and speed delivered.

Figure 3:
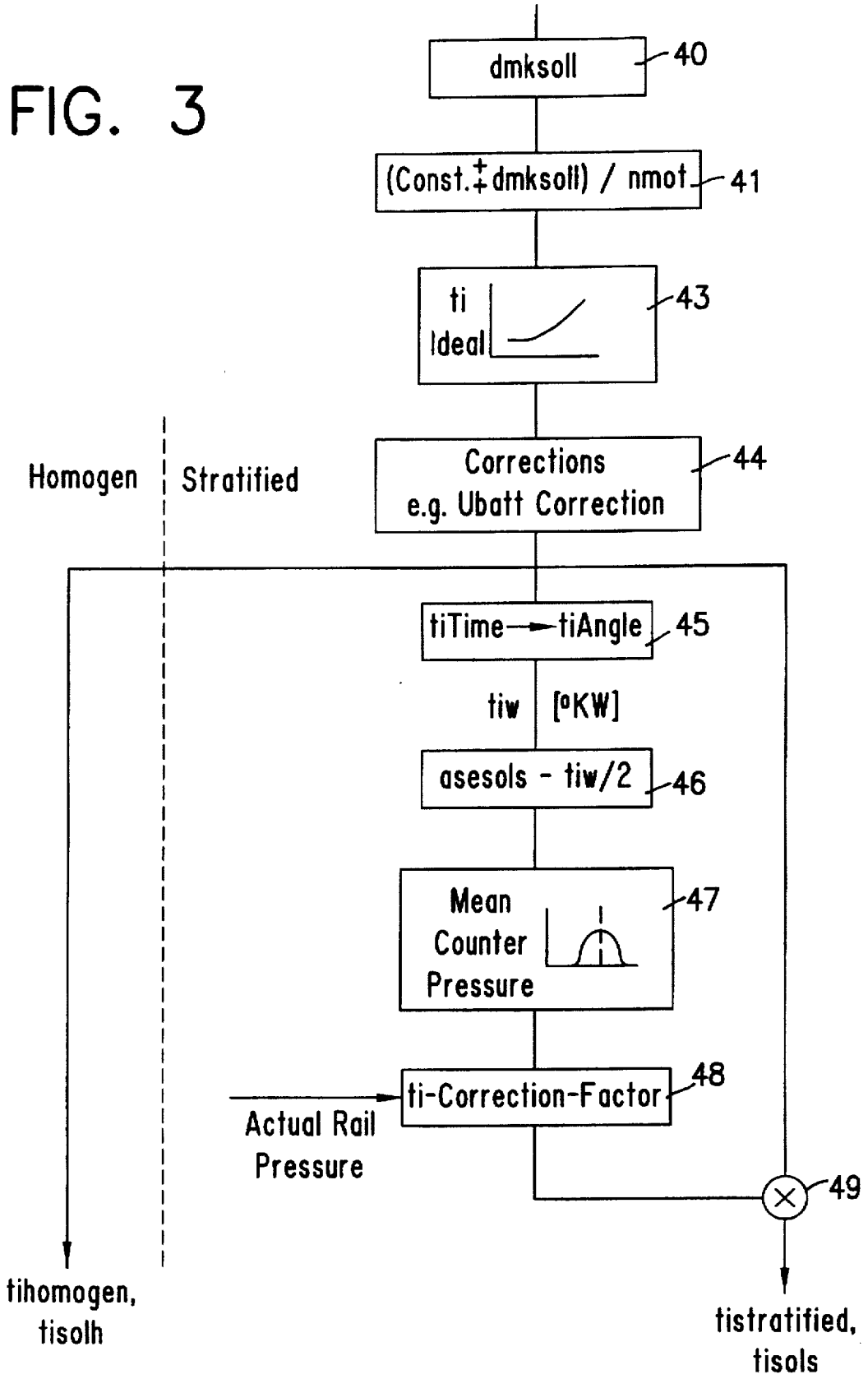
FIG. 3 shows a flow chart for converting the fuel mass flow into injection times for stratified and homogeneous operation.

FIG. 3 shows a block diagram for converting the fuel mass flow signal dmK into injection times (tisolh, tisols) of the injection valve in homogeneous and stratified operation.

The fuel mass flow value dmK supplied by output 23 of FIG. 2 should be available in block 40 as a setpoint in grams per second. In the subsequent block 41, it is converted into grams per stroke using the speed nmot and a constant. Subsequently, in block 43 a value ti_ideal is computed using the characteristic curve of a valve; ti_ideal is subjected to a correction in block 44, where all the correction factors, such as for example the Ubatt correction, are taken into account. A value concerning injection time for homogeneous operation tisolh is then available at the output. To obtain a similar value for stratified operation (tisols), the value corrected in block 44 (tisolh) must be further corrected as follows: The injection time is converted into an injection angle according to the formula dϕ=nmot*6*ti in block 45. Since the injection time correction for stratified operation must take into consideration mainly the cylinder pressure at injection time, the angle for the middle of the injection phase during stratified operation is determined in additional block 46. For this purpose, one-half of the injection angle tiw obtained in block 45 is subtracted from the value of asesols (control end setpoint, stratified operation) with the result that the central angular position of the crankshaft during injection in stratified operation is now available. Subsequently the compression pressure at the time the crankshaft assumes its central angular position during injection is determined in block 47 from this value using a characteristic curve, so that a measure for the mean counterpressure can be obtained when calculating the injection signal for stratified operation. This mean counterpressure forms, together with a signal of the fuel pressure available (actual rail pressure), the input values of a correction stage 48, which can be implemented, for example, using a map. The output value is supplied to a multiplicator 49, where the output signal of block 44 (tisolh) is multiplied by the correction factor of correction stage 48, at whos output the injection signal tisols for stratified operation is then available.

FIG. 3 illustrates that, based on the fuel mass flow dmKsoll in homogeneous and stratified operation, the individual injection times are supplied. When the injection signal for stratified operation is supplied, the counterpressure in the cylinder at that time is processed as an essential correction factor. Therefore, it is possible to refer the injection time to the intake pressure during homogeneous operation, while during stratified operation the higher counterpressures that prevail then must be taken into account for determining the fuel injection.

Figure 4:
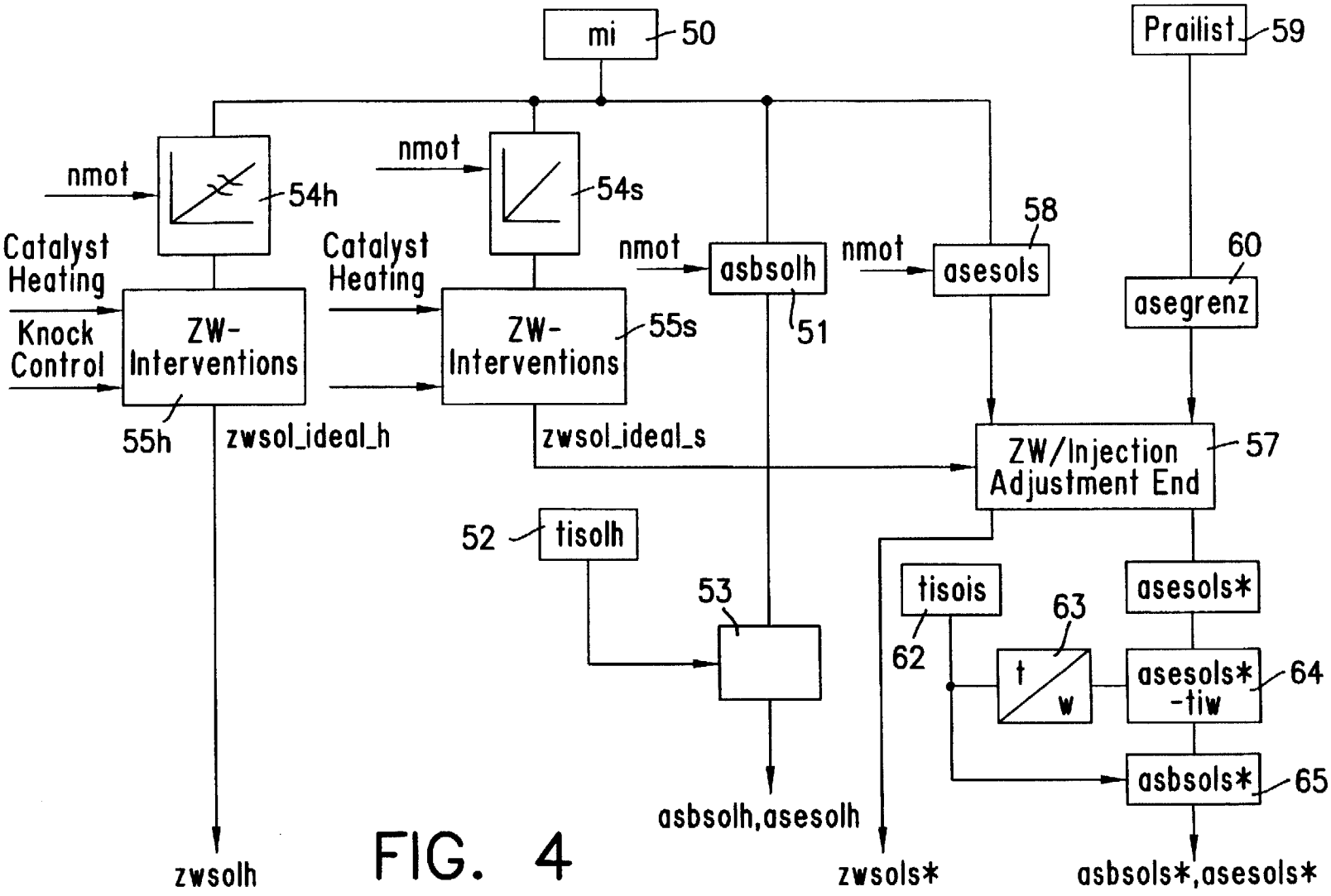
FIG. 4 shows a flow chart for outputting the control signals (control start, control end) for the injection valves, as well as the ignition angle.

FIG. 4 deals with obtaining values of the injection position and ignition angle in homogeneous and stratified operation on the basis of the indicated engine torque mi in block 50, as it is also available at input terminal 20 of FIG. 2. To obtain the control value for injection in homogeneous operation, mi is sent from block 50 to a block 51 first, where a value asbsolh (control start setpoint, homogeneous operation) is obtained as a function of mi and the speed nmot for control start in homogeneous operation. In connection with the injection value tisolh for homogeneous operation from block 52, which is available after block 44 of FIG. 3, the two values for start (asbsolh) and end (asesolh) of the injection signal are supplied in block 53 (control start setpoint, homogeneous operation; control end setpoint, homogeneous operation). This takes place, for example, by the control signal for start (asbsolh) being output at a certain angle or a certain time for a time period determined by the injection time tisolh in homogeneous operation.

The left-hand signal processing column of FIG. 4 concerns ignition. An ignition angle setpoint ZWsolh is read from a map as a function of the speed nmot (block **54*h*) when the indicated engine torque mi is supplied by block 50. This setpoint is then corrected in a block 55*h*** as a function, for example, of a desired catalyst heating or knock control, resulting in an ideal ignition angle setpoint ZWsoll_ideal_h. For homogeneous operation, this ideal ignition angle setpoint can be considered as directly usable, so that it corresponds to the ignition angle setpoint in homogeneous operation (zwsolh).

In stratified operation, adjustment is provided between ignition angle and injection end, which is done within a block 57. An ideal ignition angle zwsoll_ideal_s is required as a first input value. It is obtained from mi and nmot using a map (block **54*s*), as well as from other factors influencing the ignition angle, for example, catalyst heating (block 55*s*). A value for control end setpoint in stratified operation (asesols) is also needed in addition to the ideal ignition angle setpoint ZWsol_ideal_s; asesols is obtained from mi (block 50) from a map 58, as a function of a speed signal nmot. Furthermore a limit value for control end is supplied to block 57 (asegrenz). This is obtained as a function of the prevailing fuel pressure prail_ist (block 59) from a suitably configured curve plotting the control end limit value (asegrenz) against the actual fuel pressure (prail_ist) in block 60**.

On the output side block 57 supplies a value for the ignition angle setpoint in stratified operation* (ZWsols*) to make the adjustment between ignition angle and the injection end, and a suitably adjusted value for control value setpoint in stratified operation* (asesols*). In order to arrive from this value to control start setpoint in stratified operation* (asbsols*), it is required, according to FIG. 4, to compute back from control end setpoint in stratified operation* (asesols*), which takes place using the injection time for stratified operation (tisols) from block 62. The value for tisols is converted to an angle in a time/angle converter 63, in order to compute the actual control start setpoint in stratified operation* (asbsols*) from asesols* in the next block 64. The start and end of the control signal for the injection valve in stratified operation can then be obtained via block 65.

FIG. 5 explains the processes taking place in adjustment block 57 of FIG. 4. In FIG. 5 the cylinder pressure Pzyl is plotted against the crankshaft angle KW. A pressure increase can be observed during the compression stroke, which has its maximum at the Top Dead Center (TDC); here only the pure compression pressure is marked without the effects of a combustion process. An ignition angle window ZWF is represented in the lower part of this diagram, showing the range where ignition may or should take place. A range of the control end is represented in the upper part of the diagram of FIG. 5, which corresponds to a control end window (asef) at a given ignition angle, depending on the situation. The control end is within this range in the case of stratified operation. It is critical that the control end ase, as well as ignition angle ZW be adjusted to one another, so that the control end, i.e., the end of an injection cycle, is approximately 5 degrees crankshaft angle before the ignition angle.

Depending on the selected or computed fuel pressure, it must be ensured that the injection valve is not opened or kept open at the time when the compression pressure has exceeded the injection pressure. Otherwise there would be a danger of the compression pressure pushing back the fuel in the injection valve, which is known to people in the industry as "blow-back hazard." Therefore a limit value is selected for the control end (asegrenz) as a function of the pressure characteristics in the cylinder and attention is ensured that the control end is not to the right of the limit value asegrenz of FIG. 5.

Figure 6:
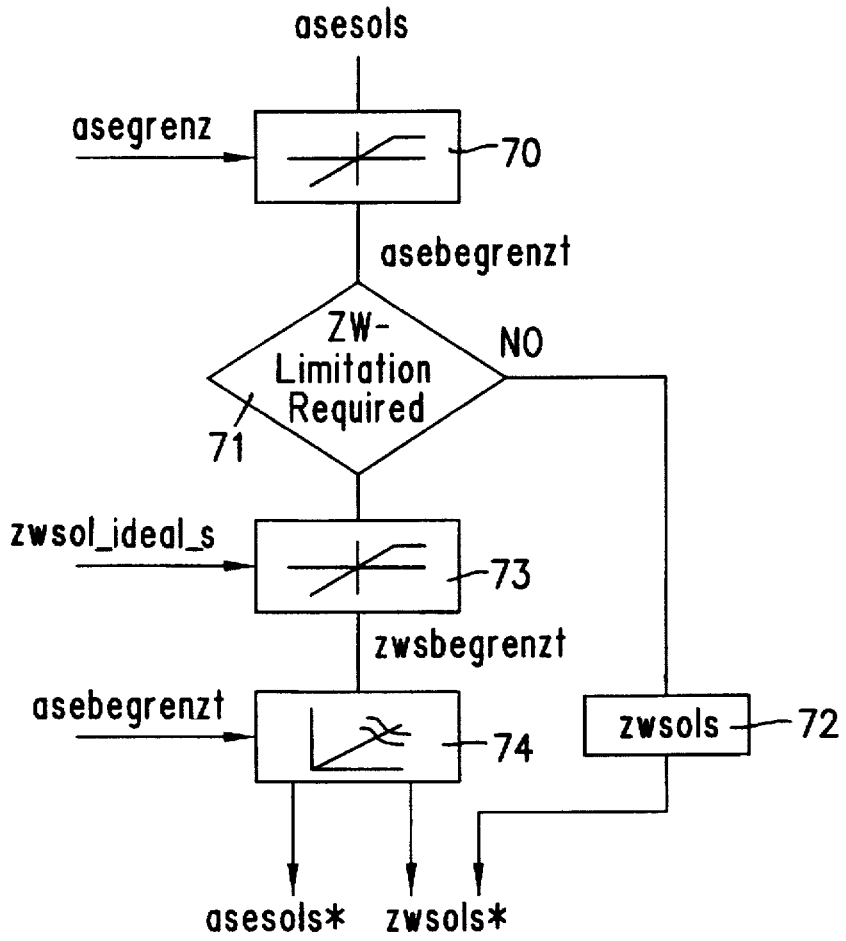
FIG. 6 shows a flow chart with the relationship between ignition angle and injection signal control end.

The corresponding program steps are illustrated in FIG. 6. The value for the control end setpoint in stratified operation (asesols) obtained in block 58 of FIG. 4 is limited in a manner known per se in a limiting block 70 as a function of the limit value asegrenz from block 60. A query 71 follows regarding whether the ignition angle must also be limited due to the condition that the ignition angle may not be farther than approximately 5 degrees crankshaft angle after the injection end. If this is not the case, then the ignition angle setpoint zwsols for stratified operation is output via block 72. If, however, limitation is required, it is carried out in a subsequent ignition angle limiting unit 73, where the ignition angle is limited to a limit value (zwsbegrenzt). This is followed by a map 74, where the setpoints of the control end and the ignition value in stratified operation are output as functions of the ignition angle limit value (zwbegrenzt) from block 73 and the limit value for the control end (asebegrenzt).

What is claimed is:

1. A control device for a direct-injection gasoline internal combustion engine having sensors for sensing operating parameters and a plurality of metering and actuating devices for controlling a fuel mass, a fuel pressure, an air mass and an ignition, the control device comprising:

a signal processing unit for controlling a fuel injection operation in at least one of a stratified mode and a homogenous mode depending on an operating zone of the internal combustion engine, wherein the signal processing unit:

determines a required engine torque;

converts the engine torque into at least one value related to a fuel mass flow value, an air mass flow value and an ignition angle value;

converts the fuel mass flow value into a first injection time value for the homogenous mode;

converts the fuel mass flow value into a second injection time value for the stratified mode; and forms control signals for at least one fuel injection valve, a throttle valve actuator and an ignition system.

2. The control device according to claim 1, wherein the engine torque is converted to at least one of the fuel mass flow value and the air mass flow value depending upon an engine speed, and an efficiency signal dependent upon at least one of the homogenous mode of the internal combustion engine and the stratified mode of the internal combustion engine.

3. The control device according to claim 1, wherein the second injection time value for the stratified mode is determined from the first injection time value for the homogenous mode depending upon an internal pressure in at least one engine cylinder.

4. The control device according to claim 1, wherein the signal processing unit determines a setpoint for a control start and a control time for the at least one fuel injection valve depending upon an internal pressure in at least one engine cylinder, and wherein a control signal end and the ignition angle value are adjusted to one another.

* * * * *